US009067093B2

(12) United States Patent
Isaacson et al.

(10) Patent No.: US 9,067,093 B2
(45) Date of Patent: Jun. 30, 2015

(54) HYBRID COMPETITION DIVING BOARD

(71) Applicants: William B. Isaacson, Stanley, ND (US); Michael Anthony Fuqua, Rochester, MN (US)

(72) Inventors: William B. Isaacson, Stanley, ND (US); Michael Anthony Fuqua, Rochester, MN (US)

(73) Assignee: Skymanor Innovations, LLC, Stanley, ND (US)

( * ) Notice: Subject to any disclaimer, the term of this patent is extended or adjusted under 35 U.S.C. 154(b) by 56 days.

(21) Appl. No.: 13/837,082

(22) Filed: Mar. 15, 2013

(65) Prior Publication Data

US 2014/0057757 A1 Feb. 27, 2014

Related U.S. Application Data

(60) Provisional application No. 61/742,863, filed on Aug. 21, 2012.

(51) Int. Cl.
*A63B 21/00* (2006.01)
*A63B 5/10* (2006.01)

(52) U.S. Cl.
CPC ..... *A63B 5/10* (2013.01)

(58) Field of Classification Search
USPC ..... 482/30, 31, 77, 26, 75, 62, 128, 111, 482/112
See application file for complete search history.

(56) References Cited

U.S. PATENT DOCUMENTS 2,546,151 A 3/1951 Buck
2,678,213 A 5/1954 Buck
2,805,859 A 9/1957 Rude
2,864,616 A 12/1958 Rude
2,919,133 A 12/1959 Eggers
2,963,294 A 12/1960 Buck
2,996,295 A * 8/1961 Smith ..... 267/178
3,072,401 A 1/1963 Rude
3,329,426 A 7/1967 Marshall
3,350,093 A 10/1967 Nightingale
3,372,927 A 3/1968 Rude
3,544,104 A * 12/1970 Jenks ..... 482/30
3,856,296 A * 12/1974 Fischer ..... 482/31
3,861,674 A 1/1975 Buck, Jr.
4,049,263 A 9/1977 Gerritsen et al.
4,303,238 A 12/1981 Rude
4,824,101 A 4/1989 Karlas (Continued)

OTHER PUBLICATIONS

International Search Report and Written Opinion for PCT/US2013/055546 mailed Nov. 8, 2013.
Alcoa Aluminum, Company Data Sheets on 6061, and 6070-T6 alloys, Feb. 24, 2012, 2 pages.
Duraflex International Corporation, Duraflex Aluminum Springboards, Literature 66-231-330, 2 pages.

(Continued)

*Primary Examiner* — Jerome w Donnelly
(74) *Attorney, Agent, or Firm* — Merchant & Gould P.C.

(57) ABSTRACT

A hybrid diving board is disclosed. The hybrid diving board may include a primary diving board having a flat skid-resistant top surface and a bottom surface extending between a first end and a second end, wherein the board first end is configured for attachment to a diving stand and the board second end is a free end. A flex spring and/or a torsional control spring may also be provided that has a first end and a second end wherein the spring is adjacent to a surface of the diving board. The flex spring first end may be configured for attachment to the diving stand or to the diving board at a location proximate the board first end. The hybrid diving board may have a spring constant and/or average modulus of elasticity that is higher than a corresponding spring constant or modulus of elasticity of the primary diving board.

33 Claims, 13 Drawing Sheets

(56) References Cited

U.S. PATENT DOCUMENTS

| | | | |
|---|---|---|---|
| 8,075,452 | B2 | 12/2011 | Isaacson et al. |
| 2012/0083390 | A1 | 4/2012 | Isaacson et al. |

OTHER PUBLICATIONS

Duraflex International Corporation, Maxiflex Model B, Part #66-231-330 and Frequently Asked Questions, Jan. 7, 2012, 5 pages.

* cited by examiner

HYBRID COMPETITION DIVING BOARD

CROSS-REFERENCE TO RELATED APPLICATIONS

The present application claims priority to U.S. Provisional Patent Application Ser. No. 61/742,863, filed Aug. 21, 2012, which is incorporated herein by reference in its entirety.

TECHNICAL FIELD

This disclosure relates to diving boards or springboards commonly used in aquatic competition diving venues and improvements thereof.

BACKGROUND

High strength extruded aluminum alloy diving boards or springboards as they are sometimes referred to have been used exclusively in aquatic competition diving venues such as the National Collegiate Athletic Association, the World Championships, and the Olympics for over the past half century. The primary function of the diving board is to vault the diver to as great a near vertical height as possible over the pool, thus allowing the diver to have time in the air to perform gymnastic maneuvers prior to entering the water. The faster the speed and acceleration of the tip of the diving board in returning to the starting horizontal position from the deflected state caused by the diver bouncing or "trampolining" near the tip end of the board, the higher the diver will be vaulted into the air, thus having more air time to perform more complex dives. Improvements in linear and torsional performance characteristics of diving boards are desired.

SUMMARY

A hybrid diving board is disclosed. The hybrid diving board may include a primary diving board, for example, an extruded aluminum diving board having a skid resistant flat top surface and a bottom surface extending between a first end and a second end, wherein the board first end is configured for attachment to a diving stand and the board second end is a free end. A flex spring may also be provided that has a first end and a second end wherein the flex spring being adjacent to the top or bottom surface of the diving board. The flex spring first end may be configured for attachment to the diving stand or to the diving board at a location proximate the board first end. The hybrid diving board may have a spring constant and/or average modulus of elasticity that is higher than a corresponding spring constant or modulus of elasticity of the aluminum diving board.

A hybrid diving board is also disclosed that has a secondary torsional control spring having a first end and a second end wherein the torsional control spring being adjacent to the top or bottom surface of the diving board. In one embodiment, the torsional control spring is secured to the primary diving board and is an anisotropic composite material. Although the secondary torsional control spring may be torsionally fixed with respect to the primary diving board, the torsional control spring can be allowed to act as a secondary flex spring with relative movement possible in a longitudinal direction. The hybrid diving board has a torsional spring constant that is greater than a corresponding torsional spring constant of the primary diving board.

DESCRIPTION OF THE DRAWINGS

Non-limiting and non-exhaustive embodiments are described with reference to the following figures, which are not necessarily drawn to scale, wherein like reference numerals refer to like parts throughout the various views unless otherwise specified.

DETAILED DESCRIPTION

Figure 1:
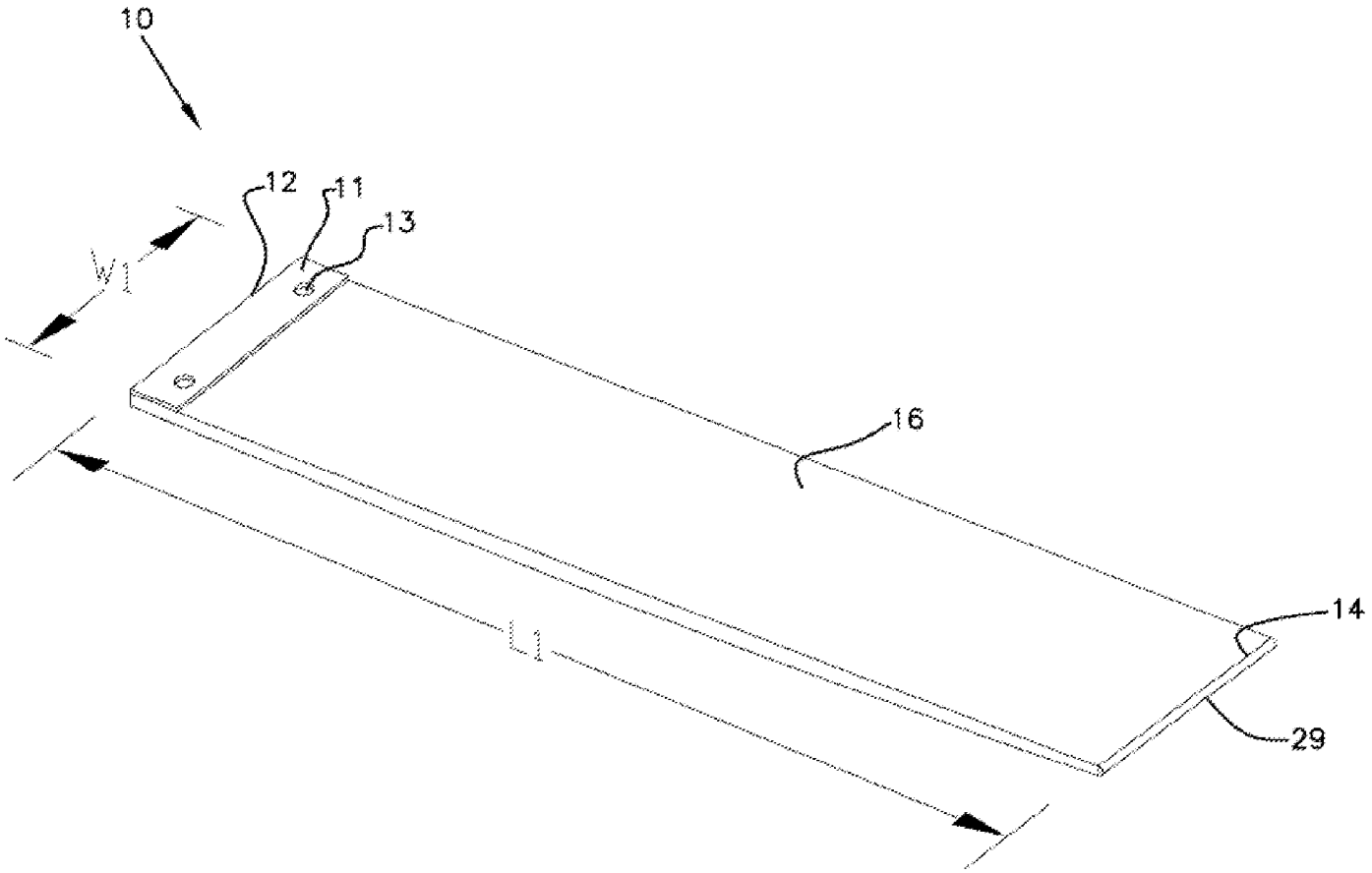
FIG. 1 is a perspective view of a primary diving board

Various embodiments will be described in detail with reference to the drawings, wherein like reference numerals represent like parts and assemblies throughout the several views. Reference to various embodiments does not limit the scope of the claims attached hereto. Additionally, any examples set forth in this specification are not intended to be limiting and merely set forth some of the many possible embodiments for the appended claims.

Figure 2A:
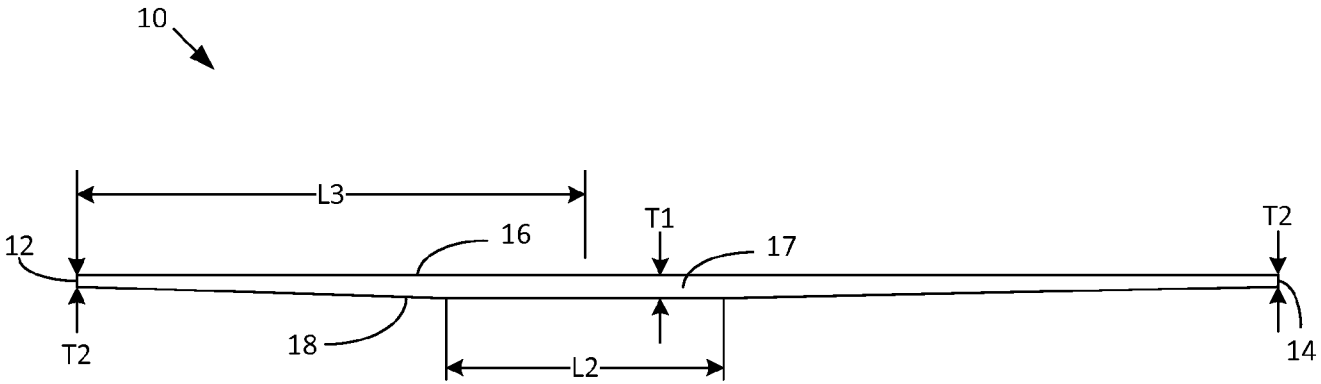
FIG. 2A is a longitudinal cross-sectional view of the diving board shown in FIG. 1 wherein the board is provided with a taper.
Figure 2B:
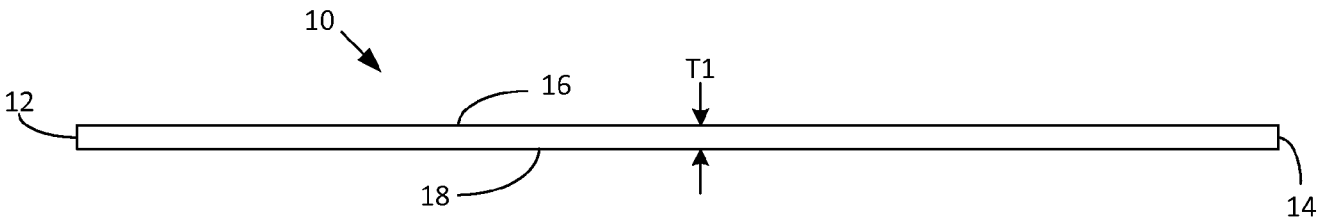
FIG. 2B is a is a longitudinal cross-sectional view of the diving board shown in FIG. 1 wherein the board is provided without a taper.
Figure 3:
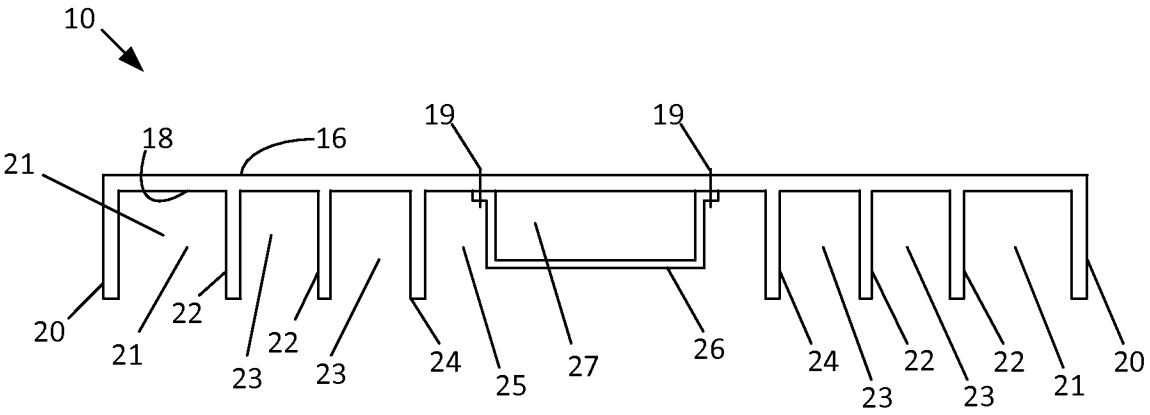
FIG. 3 is a first example of a lateral cross-sectional view of the diving board shown in FIG. 1.

Referring FIGS. 1-3, an example competition extruded aluminum diving board 10 is presented. By use of the term "competition" diving board, it is meant to include diving boards specifically manufactured for use in sanctioned diving competitions. Competition springboard diving events are generally categorized as one meter and three meter as defined by the height of the horizontal board above the water. The limitation on distance of the downward travel of the competition diving board from the horizontal position at a predetermined force is approximately one meter wherein the diving board tip would touch the water in a one meter diving event.

As shown, the diving board 10 has a first width W1 and a first length L1 extending between a first end 12 and a second end 14. A typical competition diving board will have a width W1 of about 20 inches and a length L1 of about 16 feet. The diving board 10 also defines a top surface 16 and an opposite bottom side or surface 18. As can be seen in the drawings, the top surface 16 of the diving board 10 is generally flat and is provided with a protective nose 29 at the second end 14.

In use, the diving board 10 is mechanically connected to a diving stand (not shown) at the first end 12 via an attachment bracket 11 having mounting holes 13. The diving board 10 further rests on a fulcrum roller (not shown) at a fulcrum section 17 of the diving board 10. In use, the diving board 10 will deflect at the location of the fulcrum roller. Typically, the fulcrum roller is adjustable with respect to the connected first end 12 of the diving board 10 along a length L2 of the fulcrum section 17 to allow a diver to adjust the springing action of the diving board 10. The center of the fulcrum section is a length L3 from the mounting holes 13. Typically, the length L2 of the fulcrum section 17 in a competition diving board is about 2 feet and the length L3 is about 4 feet. When installed on the diving stand, the top surface 16 of the diving board is horizontal to the water in the pool in an initial undeflected state.

Referring to FIG. 2, the diving board 10 at the fulcrum section 17 is shown as having a constant thickness T1, which is generally about 2 inches. As shown, the diving board 10 tapers to a thickness T2 at the first end 12 and to a thickness T3 at the second end 14. As shown, thickness T2 is about ⅞ inch while thickness T3 is about 1⅗ inch. One common method of manufacture of a competition diving board 10 is to provide an aluminum extrusion having a constant thickness T2 along the entire length and then to machine away material to provide the tapering to the first and second ends 12, 14. It is noted that diving board 10 may be provided with or without the tapers shown towards ends 12, 14. Referring to FIG. 2B it is shown that the diving board may be alternatively provided with a constant thickness T1 rather than a taper. Alternatively, the board 10 may be tapered in only one direction from the fulcrum section 17 towards the first end 12 or the second end 14.

Referring to FIG. 3, a first example of a cross-sectional view of the diving board 10 is presented. As shown, the diving board 10 is extruded to have a plurality of ribs 20, 22, 24 extending longitudinally from the attachment end of the diving board to the tip of the board. The ribs 20, 22, 24 are an integral part of the primary aluminum extrusion and provide strength to the upper flat surface 16 of the diving board 10 and may be tapered from the ends of the flat fulcrum section towards the attachment end and the tip of the board. Tapering of these ribs 20, 22, 24 provides additional flexibility of the extruded aluminum diving board 10 upon deflection.

As shown, ribs 20 are the outermost ribs and form a side surface of the diving board 10. Ribs 24 are the innermost ribs while ribs 22 are intermediate ribs between the outermost ribs 20 and the innermost ribs 24. In one aspect, the ribs 20 and 22 and the bottom surface 18 of the diving board 10 form a channel 21 on each side of the diving board 10 while the spaces between the two innermost ribs 24 form a channel 25. Channels 23 are also formed between the intermediate ribs 22. As shown, a total of eight ribs and seven channels are formed in the diving board 10.

Disposed in the channel 25 and between the innermost ribs 24 is a torsion box 26 extending the length of the board 10. The torsion box 26 is for enhancing torsional stability of the diving board 10 such that the diving board 10 will not excessively twist about its longitudinal axis due to a non-centered or eccentric load (i.e. a diver landing on one side of the board) at the second end 14. The torsion box 26 also provides additional linear flexion resistance to the board 10 by nature of the isotropy of the material from which it is produced. As shown, the torsion box 26 is an aluminum channel extrusion that is riveted to bottom 18 of the diving board 10 via a plurality of rivets 19. Typically, openings 15 in the diving board are drilled for the rivets 19. Once attached, the torsion box 26 and the bottom 18 of the diving board 10 form an internal cavity 27.

Figure 4:
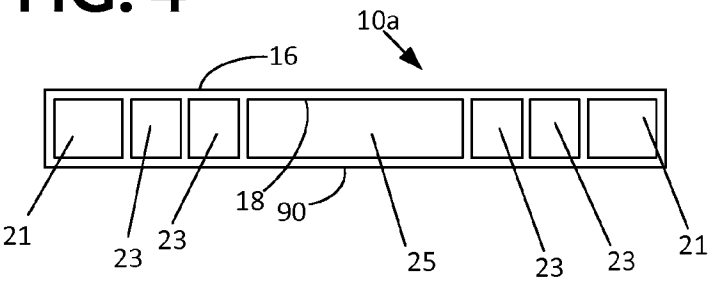
FIG. 4 is a second example of a lateral cross-sectional view of the diving board shown in FIG. 1.
Figure 5:
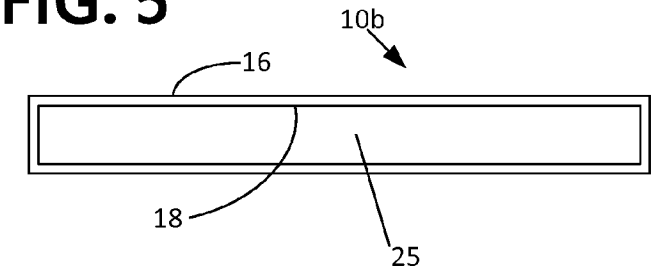
FIG. 5 is a third example of a lateral cross-sectional view of the diving board shown in FIG. 1.
Figure 6:
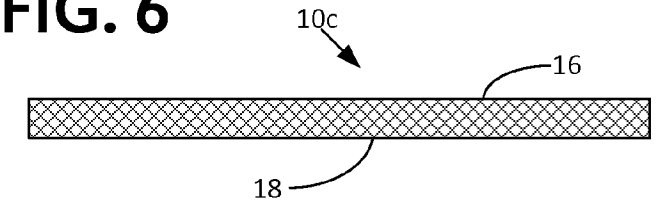
FIG. 6 is a fourth example of a lateral cross-sectional view of the diving board shown in FIG. 1.

Diving board 10 is not limited to having the above described configuration. For example, FIGS. 4 to 6, additional examples of potential cross-sections are shown for diving board 10. FIG. 4 shows a diving board 10*a* with the addition of a bottom plank 90 such that the channels 21, 23, and 25 are fully enclosed and such that a torsion box 26 is not required. FIG. 5 shows a diving board 10*b* similar to board 10*a*, but without the intermediate ribs such that one central cavity 27 is formed. FIG. 6 shows a simple board 10*c* which is made from a solid material with no channels or enclosed cavities. Many other configurations are possible.

Minor improvements have been made in the design of the aluminum springboards, since 1981. The diving board of use for Olympic divers today is the DURAFLEX MAXI-FLEX® Model "B". It is made from extruded aluminum alloy board based upon Alcoa Aluminum alloy 6070-T6. It has been designed to allow a 235 pound diver, by repeated bouncing at the tip of the board, to deflect the tip approximately one meter. An equivalent static load downward force on the tip to create the same one meter deflection would be approximately 1500 pounds. The ultimate performance may be reaching the near limit of performance based on the physical properties of the aluminum alloy itself and the physical configuration or geometry of the board design.

Secondary Flex Spring

The performance characteristics of the diving board 10 can be improved with the addition of a secondary flex spring 30 acting in a linear direction to form a hybrid diving board. The design geometry of the diving board 10 and the secondary flex spring 30, which may extend partial or full length of the diving board 10, can be such that it does not significantly inhibit the deflection profile of the extruded aluminum alloy board 10 for a given deflection distance. By use of the term "deflection profile" it is meant to describe the shape of the arc or curvature formed along the length of the board 10 when in a deflected state. The hybrid system avoids significantly hindering the downward movement achieved of the diving board 10 alone, while at the same time, increasing the tip speed and rate of acceleration in returning to its undeflected starting position. The rate of return of the deflected hybrid board to its initial horizontal starting position is faster than that of the extruded aluminum alloy board 10 by itself because the underlying secondary flex spring 30 is forcing the extruded aluminum board 10 upward at a faster rate than it would normally be capable of achieving without the secondary spring 30. Furthermore, the flex spring 30 can be used to form a hybrid diving board with an extended useful life over traditional aluminum diving boards 10, and can also be utilized to extend the useful service life of an existing diving board 10 in a retrofit application. However, it is noted that a retrofit may not be an optimal solution in comparison to designing the diving board 10 specifically to accept the flex spring 30.

In order to provide the aforementioned additional upward force on the diving board 10, the spring constant of the flex spring 30 can be equal to or greater than the spring constant of the diving board 10. Accordingly, the spring constant of the hybrid board will then be greater than the spring constant of the diving board 10 alone. The spring constant of the flex spring 30 is a function of the material(s) used to form the flex spring 30 and the overall geometry of the flex spring 30. For example, the spring constant increases with increases in the width and thickness of the board 10 (i.e. increases the second moment of area) and decreases with increases to the length of the board 10. Also, the longitudinal modulus of elasticity (elastic modulus) is directly proportional to the spring constant value. Furthermore, the means and location of the attachment of the flex spring 30 to the board 10 affect the performance of the diving board (e.g. tip speed, tip acceleration, return rate, etc.). Accordingly, the desired degree to which the flex spring 30 assists the diving board 10 in accelerating the rate of return of the diving board 10 can be achieved through materials selection and design.

As the elastic modulus of a material is proportional to the spring constant of a cantilevered object, such as the diving board 10 and the flex spring 30, material selection for the flex spring can be an important consideration. Accordingly, materials for the flex spring having a higher elastic modulus than the materials used in the diving board can be advantageous. For example, 6070-T6 aluminum, which is a typical material used for a diving board 10, has a longitudinal modulus of elasticity of about 50-60 gigapascals (GPa). In contrast, the average longitudinal elastic modulus of the secondary flex spring 30 which is the subject of this disclosure are equal to or above 50-60 GPa, preferably at least 70 GPa, and even more preferably between 100 GPa and 400 Gpa. Carbon fiber epoxy composite laminates which are a preferred material of construction for the secondary flex spring 30 typically have GPa values in the 125-150 range. Materials and methods of construction are further discussed in later sections of this disclosure.

Figure 7:
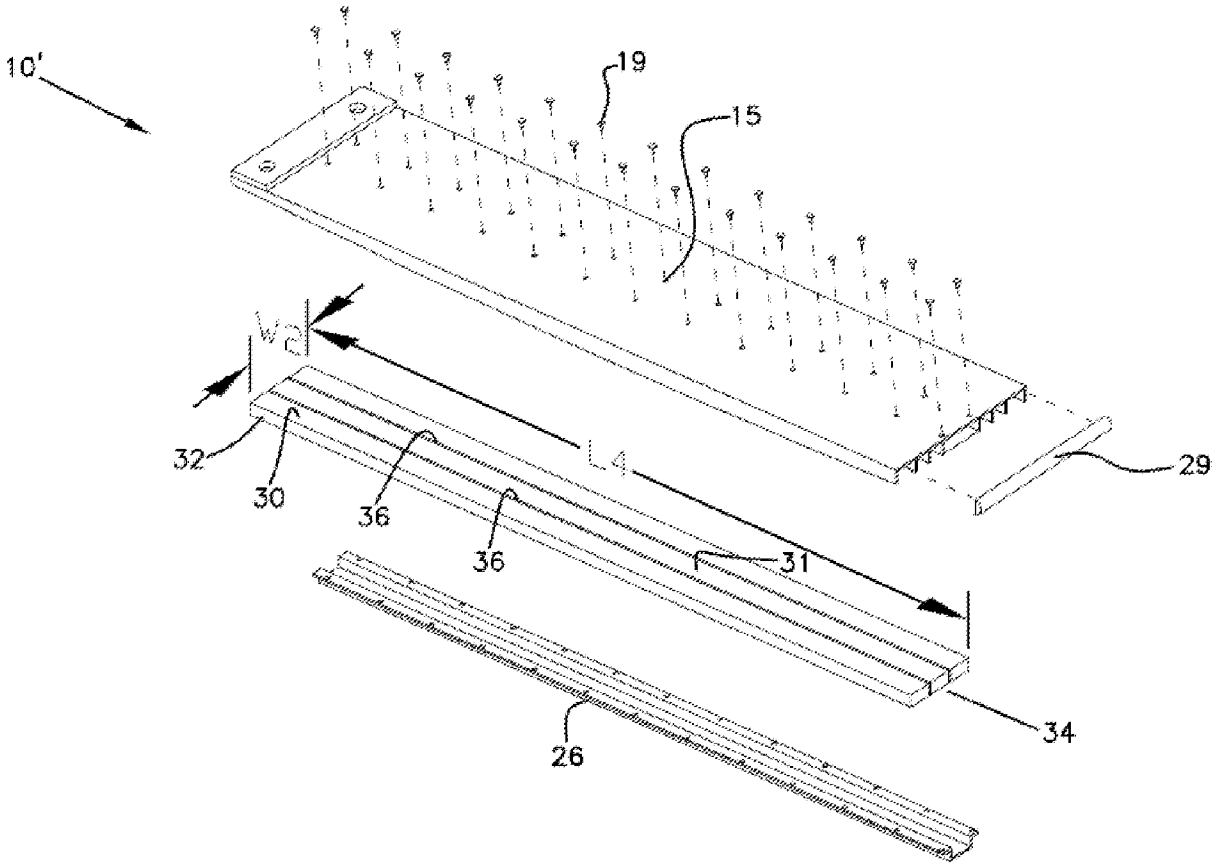
FIG. 7 is an exploded perspective view of an embodiment of a hybrid diving board having a secondary linear flex-spring with features that are examples of aspects in accordance with the principles of the present disclosure.

Referring to FIG. 7, the secondary flex spring 30 has a width W2 and a length L4 extending between a first end 32 and a second end 34, and is configured to be attached at the first end 32 to the diving board 10 where the diving board 10 is attached to the diving stand. The secondary flex spring 30 lays adjacent to the bottom side 18 of the extruded aluminum alloy structure and can be configured to be essentially free floating along most of the board's longitudinal length. The free floating design of the secondary flex 30 spring thus does not significantly alter the normal deflection profile of the aluminum alloy board while obtaining maximum leverage of the action of the secondary flex spring, thereby enhancing the tip speed and acceleration of the aluminum alloy board. Alternatively, the flex spring 30 may be bonded to the bottom surface 18 of the diving board with an adhesive or mechanically fastened at multiple locations such that the flex spring 30 and board 10 are in a completely fixed relationship. Such a configuration would change the deflection profile of the board 10, but would also operate to provide greater torsional stability (discussed later) to the board 10. It is also noted that the flex spring 30 can be configured to extend only a portion of the length of the board 10 such that the deflection profile of the diving board 10 is also altered.

As shown, the flex spring 30 can be configured for installation within the volume of the internal cavity 27 defined between the torsion box 26 and the bottom surface 18 of the diving board 10, such that the flex spring 30 is hidden from view (i.e. no portion of the linear flex spring is externally exposed). As shown, the top surface 31 of the flex spring 30 can be provided with two parallel channels 36 for accommodating internal ribs, where such ribs exist on the board 10. The channels 36 allow for the top surface 31 to be in direct contact with the bottom surface 18 of the diving board 10.

The cross-sectional shape of the flex spring 30 may be provided in a number of configurations. Referring to FIG. 7, the flex spring 30 is shown as having a generally rectangular cross-sectional shape. However, the flex spring 30 can also be provided with a generally trapezoidal cross-sectional shape that partially fills the volume of the interior cavity 27 of a similarly shaped torsion box.

Figure 8:
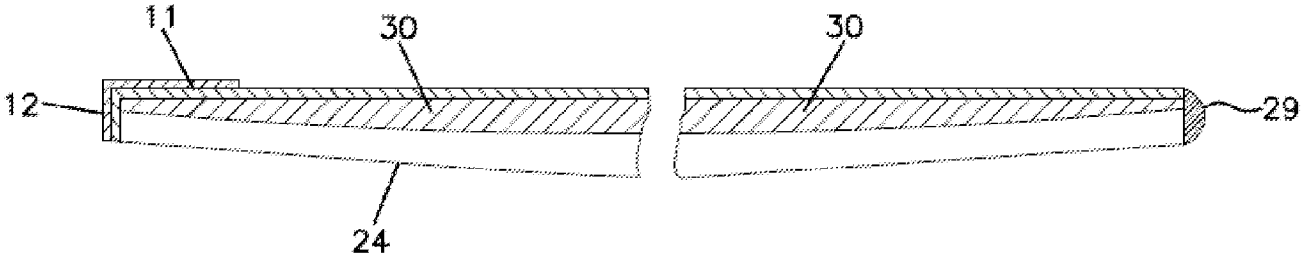
FIG. 8 is a longitudinal cross-sectional view of the diving board shown in FIG. 4 with the linear flex-spring configured adjacent to a bottom surface of the diving board.
Figure 9:
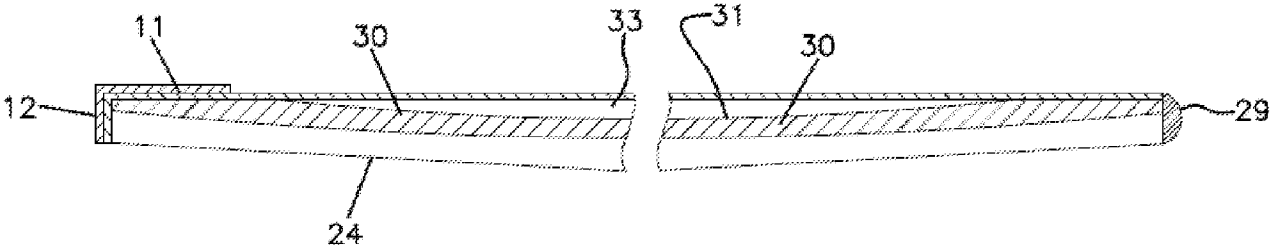
FIG. 9 is a longitudinal cross-sectional view of the diving board shown in FIG. 4 with the linear flex-spring configured in an aspheric relationship to a bottom surface of the diving board.

Referring to FIGS. 8 and 9, it is shown that the flex spring 30 can be provided, in an undeflected state, as a straight structure or a curved structure, respectively. FIG. 8 shows the flex spring 30 in a straight configuration wherein the top surface 36 of the flex spring 30 is adjacent to the bottom surface 18 of the diving board 10 along the length of the flex spring 30. Such a configuration would not be expected to change the deflection profile of the board 10 as the flex spring 30 and the board 10. FIG. 9 shows the flex spring 30 with an upward aspheric curve such that a portion of the top surface 31 of the flex spring 30 is not in contact with the bottom surface 18 of the diving board 10. By use of the term "aspheric" it is meant that the surface is curved with a radius that changes from point to point along its length. As a result, a gap 33 is formed between the flex spring top surface 31 and the board bottom surface 18. In this latter configuration, the flex spring 30 functions as a reverse spring which can further enhance the spring action of the flex spring 30 forcing the aluminum diving board 10 to return to its normal horizontal state faster than if it were a flat spring, as shown in FIG. 8. It is also noted that FIG. 8 shows the flex spring 30 having a varying cross-sectional height along the length of the flex spring 30. This varying height can be selected such that the hybrid diving board has a deflection curve or profile that is as close as possible to the deflection curve or profile of the diving board 10 by itself.

Figure 10:
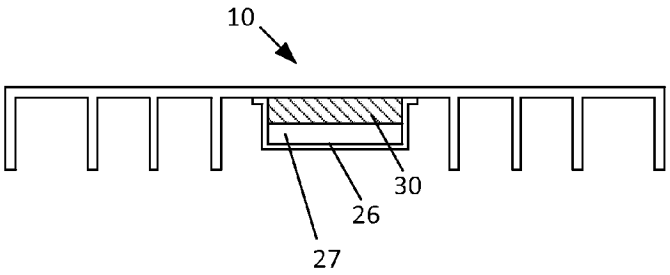
FIG. 10 is a first example of a lateral cross-sectional view of the diving board shown in FIG. 1 with the addition of a linear flex-spring.
Figure 11:
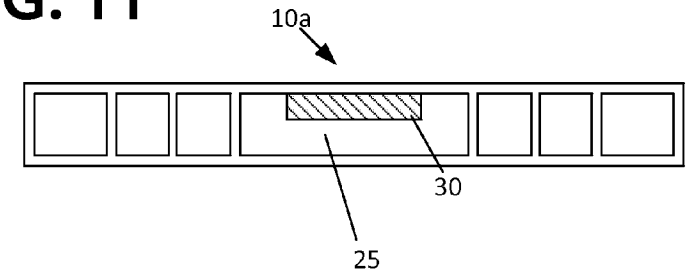
FIG. 11 is a second example of a lateral cross-sectional view of the diving board shown in FIG. 4 with the addition of a linear flex-spring.
Figure 12:
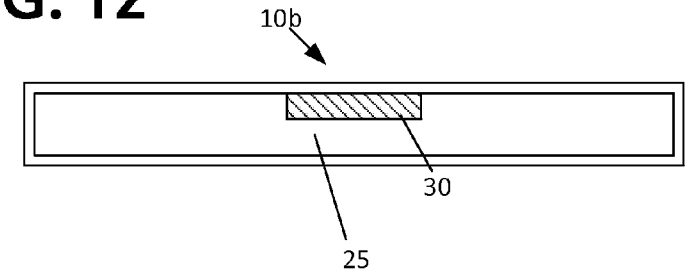
FIG. 12 is a third example of a lateral cross-sectional view of the diving board shown in FIG. 5 with the addition of a linear flex-spring.

Referring to FIGS. 10-12, examples of the location and orientation of the flex spring 30 are shown. For example, FIG. 10 shows the flex spring mounted within the space of the interior cavity 27 defined by the torsion box 26 consistent with FIG. 7. FIG. 11 shows the flex spring 30 extending within the central cavity 25 of diving board 10*a* while FIG. 12 shows the flex spring 30 disposed within the single large cavity of diving board 10*b*. It is again noted that the flex spring need only be supported at the first end 12 of the diving board nearest the diving stand and can be otherwise free-floating along the length of the board 10.

Figure 13:
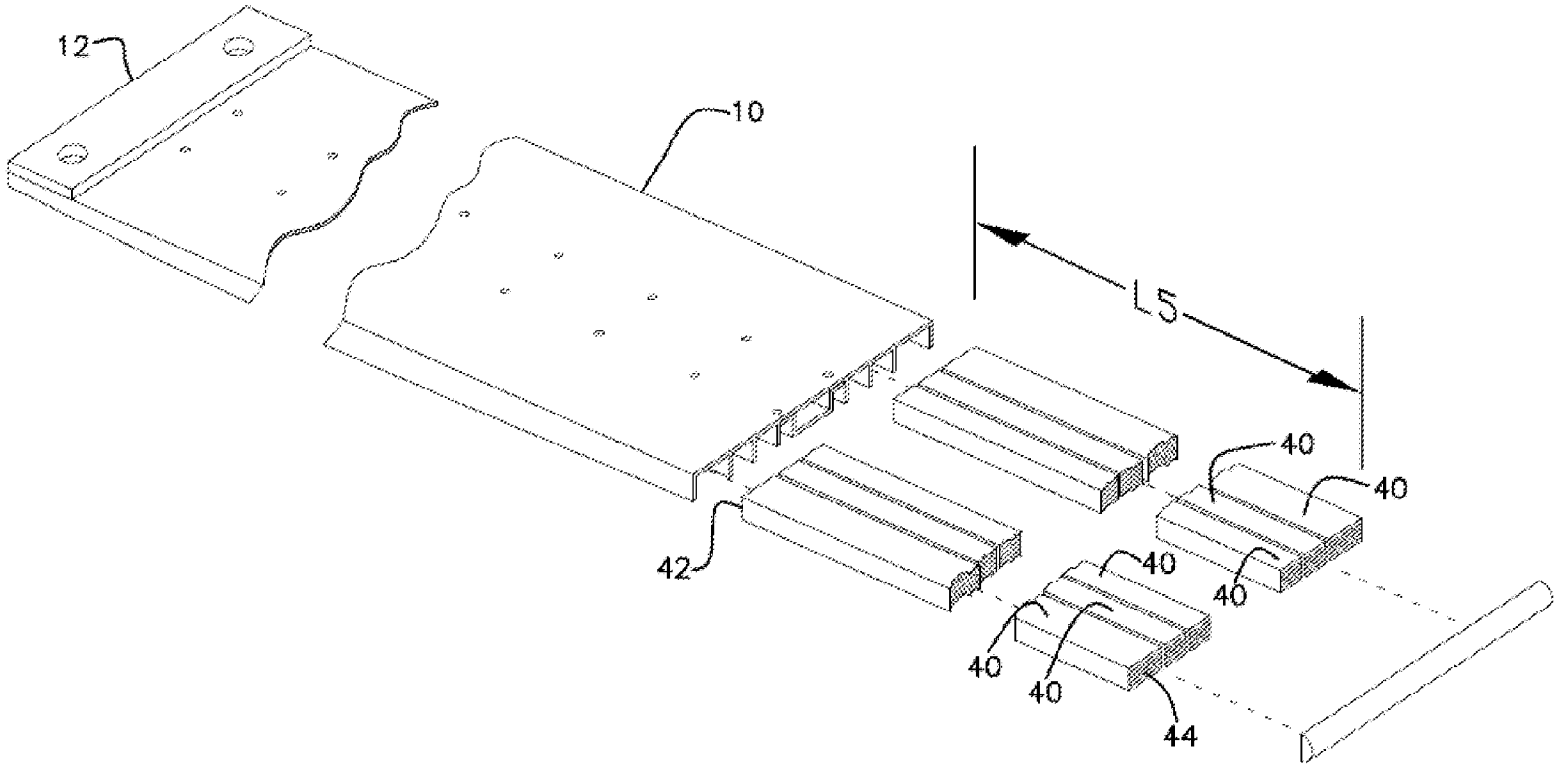
FIG. 13 is an exploded perspective view of an embodiment of a hybrid diving board having a plurality of linear flex-springs with features that are examples of aspects in accordance with the principles of the present disclosure.
Figure 14:
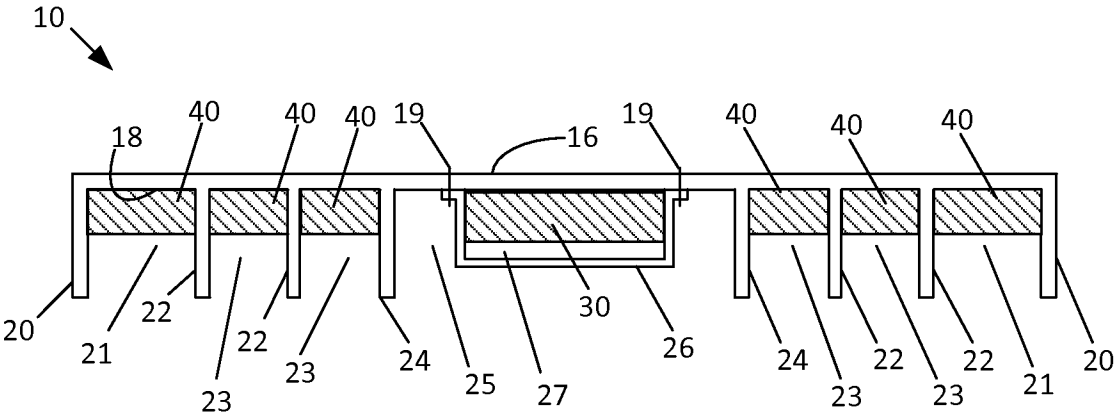
FIG. 14 is a lateral cross-sectional view of the hybrid diving board shown in FIG. 13.

Referring to FIGS. 13 and 14, an embodiment is shown in which additional secondary flex springs 40 are provided in the ribbed channels 21, 23 in addition to the centrally located flex spring 30. As many of the concepts and features of the flex springs 40 are similar to the flex spring 30, the description for the flex spring 30 is hereby incorporated by reference for the flex springs 40. The number of flex springs 40 contained within the rib channels 21, 23 should be symmetrical when viewed in cross-section, such that the board deflection properties are uniform across the entire width W1 of the board 10. As shown, six flex springs 40 are provided, however, more or fewer may be provided as desired, for example 2, 4, or 8 secondary flex springs 40. In one embodiment, the secondary flex springs 40 are attached to the diving board 10 only at the location where the diving board 10 is attached to the diving stand. They may extend any length L5 from the attachment end 42 to the tip end 44 and may vary in cross-sectional geometry as long as symmetry is maintained across the latitudinal axis of the diving board 10 at any given location. Such additional flex springs 40 may also be added to boards 10*a*, 10*b*, and 10*c*, as desired.

Torsional Control Spring

As briefly mentioned previously, the flex spring 30 can also be configured to enhance the torsional stability of the diving board by acting as a torsional control spring. Accordingly, flex spring 30 can simultaneously act as a linear flex spring and a torsional control spring. Alternatively, a torsional control spring 50 can be provided which is configured to provide torsional resistance that does not alter the desired deflection or spring action of the main springboard when placed under longitudinal flexure. In either configuration, a torsional control spring provides latitudinal torsional stability to a main aluminum springboard when uneven latitudinal forces are applied to the board. Accordingly, a torsional control spring can be utilized to augment or replace a standard aluminum torsion box 26.

A typical torsion box 26 for a diving board 10 is manufactured from aluminum which is an isotropic material. However, improved torsional resistance can be obtained with the use of anisotropic materials, and in particular, anisotropic composite materials. By use of the term "isotropic" it is meant that the properties of a material are identical in all directions. By use of the term "anisotropic" it is meant that the properties of a material depend on the direction of the material.

Using an anisotropic material allows for the reduction in the weight of the torsional control spring 50, compared to that obtainable in a torsional control spring (e.g. torsion box 26) made of an isotropic material such as an aluminum alloy. An anisotropic material design requires less reliance on geometry to provide proper torsional stability due to preferable orientation. This allows for potential reductions in the necessary cross sectional area of material required along the length of the board, and thus overall material needed, to achieve adequate torsional resistance. Polymeric composite materials also have generally lower densities than isotropic metals. For example, a carbon fiber epoxy composite has a density of approximately 1.60 grams per cubic centimeter (g/cc) compared to the density of a typical aluminum alloy, for example a density of 2.71 g/cc for the 6070-T6 aluminum alloy currently used in most competitive diving boards. This reduction in weight allows for a faster moving board tip speed, as it requires less energy to return the board back to neutral after deflection. In turn, this provides an advantage to divers when looking to maximize spring action provided by the board for aerobatic activities upon separation from the board.

The use of an anisotropic composite material for the torsional spring component also allows the flexural performance of the spring board system to be more dominantly determined by the design of the main aluminum linear flex spring, since anisotropy orientation can be designed to yield minimal resistance to flexural deformation. The implementation of this secondary composite torsional control spring 50 can then be implemented in a variety of means, as shown in FIGS. 15-21, and described further below. This includes a spring 50 residing between webs on the underside of an extruded aluminum beam, or along the topside of an extruded aluminum beam providing a new top surface to the board.

Figure 15:
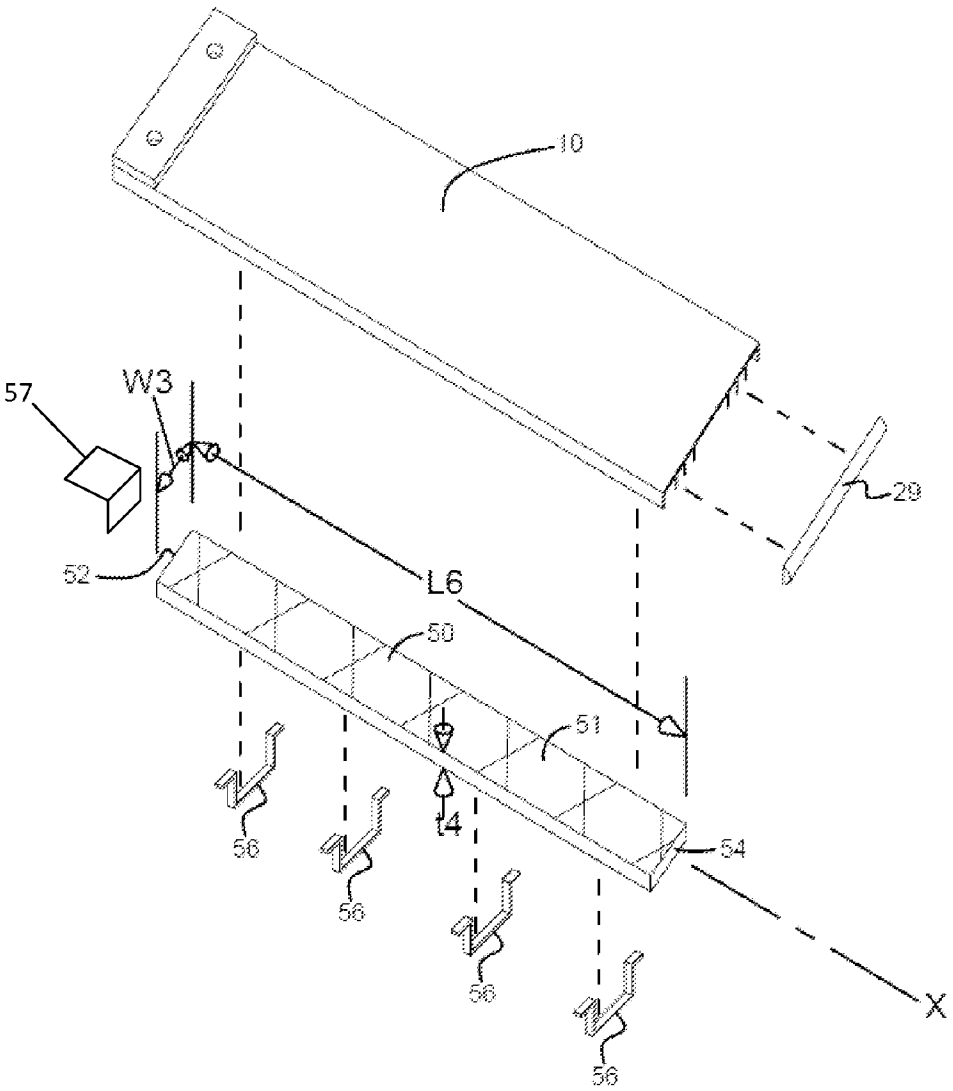
FIG. 15 is an exploded perspective view of an embodiment of a hybrid diving board having a secondary torsion control spring that are examples of aspects in accordance with the principles of the present disclosure.
Figure 16:
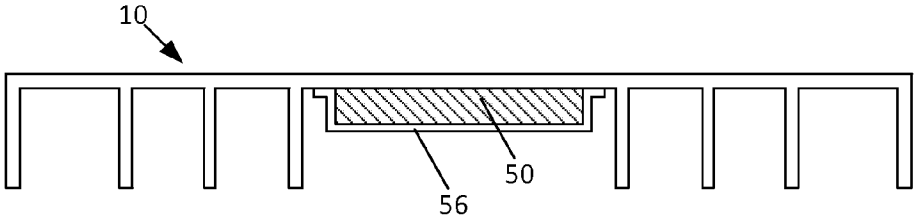
FIG. 16 is a lateral cross-sectional view of a first example cross-sectional shape of the hybrid diving board shown in FIG. 15.

Referring to FIGS. 15-16, the torsional control spring 50 has a width W3 and a length L5 extending between a first end 52 and a second end 54. As shown, the torsional control spring 50 is configured to be attached directly to the bottom surface 18 of the diving board 10 by a plurality of brackets 56. As shown, control spring 50 has a length L6, a width W3, and a thickness t4.

In one embodiment, the torsional control spring 50 is a carbon fiber reinforced epoxy matrix composite laminate plank having a length L6 of 188 inches and a width W3 of 8 inches. The diving board 10 exists as the longitudinal flex spring, while the composite plank exists as a torsional control spring 50. The control spring 50 resides on the bottom side of the extruded aluminum diving board 10 between the two inner most ribs 24, longitudinal center axes aligned. The torsion control spring 50 is oriented such that a 4 inch spacing between the board first end 12 and the control spring 50 first end, thereby leaving room for hardware for securing the board 10 to a fixture. As shown, the composite plank torsional control spring 50 and the aluminum diving board are aligned even at their respective second ends 14, 54 and covered by the protective nose 29.

In one embodiment, a carbon fiber epoxy composite is provided for torsional control spring 50 that has a thickness t4 of 0.25 inches and having a fiber orientation of [±60] degrees with respect to a longitudinal axis X of the diving board 10 and torsional control spring 50, such the majority of fiber orientation is directed width wise along the control spring 50. This configuration provides for torsional resistance, while only adding minor longitudinal flexural resistance in comparison to an isotropic material or and anisotropic, unidirectionally oriented fiber composite. Thus, the aluminum board 10 dictates the linear flexural properties, with only minimal contribution from the composite beyond torsional control.

As stated above, the diving board 10 and the torsional control spring 50 can be mated with a series of evenly spaced brackets 56. In one embodiment, four brackets 56 are provided as aluminum bands, each band being 1.5 inches in depth, 0.25 inches thick, and shaped in a flanged u-channel manner such that they wrap around the composite plank control spring 50. In one embodiment, the brackets 56 can be secured to the aluminum board 10 with rivets on their flanges. This approach provides a secure mechanical mate between the aluminum diving board 10 and the composite planks of the torsional control spring 50 without placing holes within the composite, which could cause undesirable stress concentrations and cause for failure. It is noted that more or fewer brackets 56 could be provided, such as 2, 6, 8, and 10 brackets. It is further noted that the torsional control spring 50 could be bonded to the diving board bottom surface 18 with an adhesive in addition to or instead of using brackets 56.

In order to prevent the torsional control spring 50 from sliding along the length of the diving board 10, the first and second ends 52, 54 can be further secured to the board 10. For example, the second end 14 of the aluminum diving board 10 can be provided with a rolled edge and/or protective nose 29. The first end 52 of the control spring 50 can be secured by a riveted aluminum angle 57 mounted to the diving board bottom side 18 and oriented flush against the first end 52.

Figure 17:
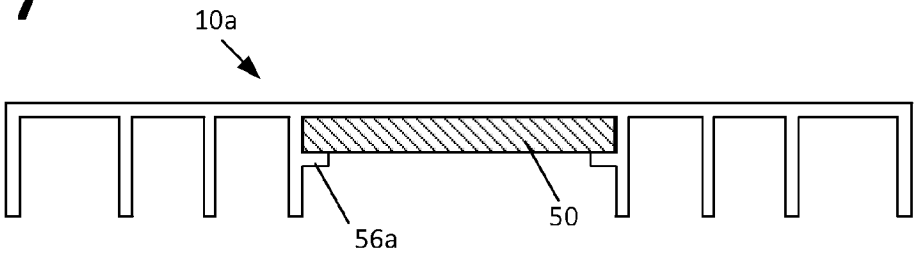
FIG. 17 is a lateral cross-sectional view of a second example cross-sectional shape of the hybrid diving board shown in FIG. 15.
Figure 18:
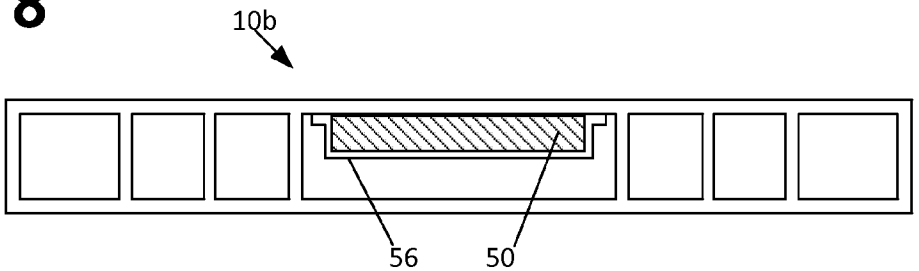
FIG. 18 is a lateral cross-sectional view of a second example cross-sectional shape of the hybrid diving board shown in FIG. 15.

The secondary torsion control spring 50 can also be used with other diving board types, as shown in FIGS. 17-18. It is noted that since the boards 10*a*, 10*b* shown in FIGS. 17, 18, respectively, are fully enclosed, that the torsion control spring 50 could most easily be torsionally secured to the diving board at the first and second ends 12, 14. With specific reference to FIG. 17, the diving board 10*a* may be provided with extruded legs 56*a* configured for torsionally restraining the control spring 50 but still allowing for the spring 50 to slide against the board 10*a* in a longitudinal direction as the board 10*a* is being deflected. Instead of an extrusion, legs 56*a* may be separate components that are fastened to the board 10*a* in a number and at intervals so desired.

Figure 19:
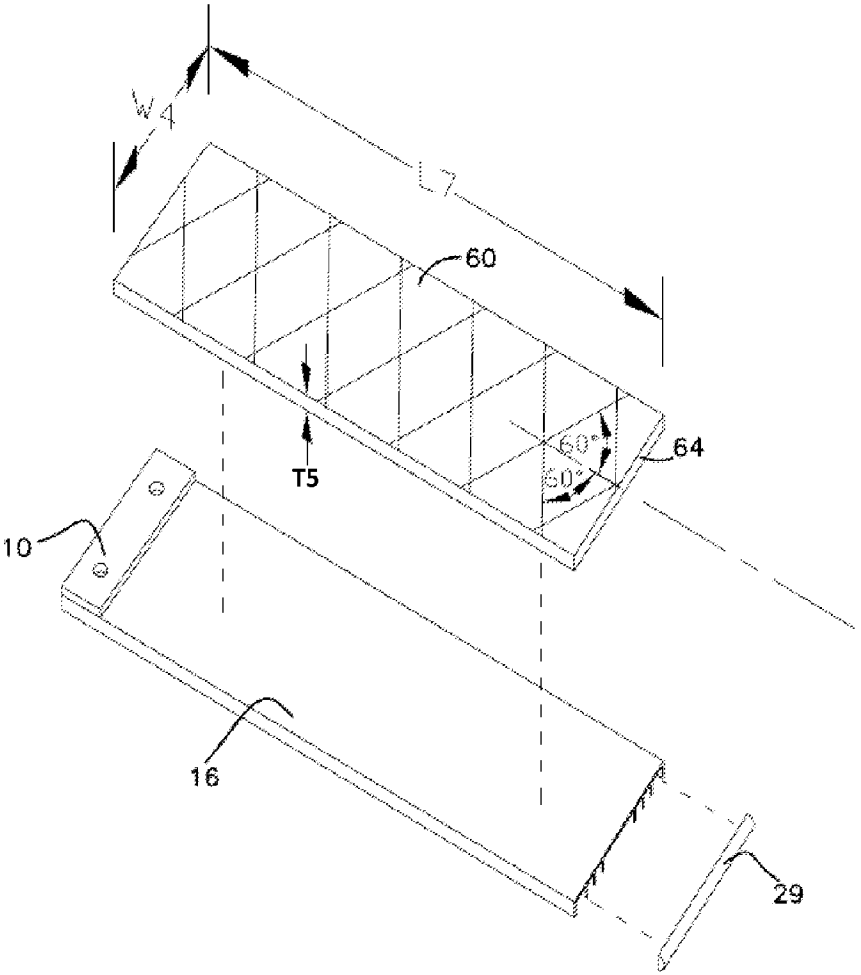
FIG. 19 is an exploded perspective view of an embodiment of a hybrid diving board having a secondary torsion control spring that are examples of aspects in accordance with the principles of the present disclosure.
Figure 20:
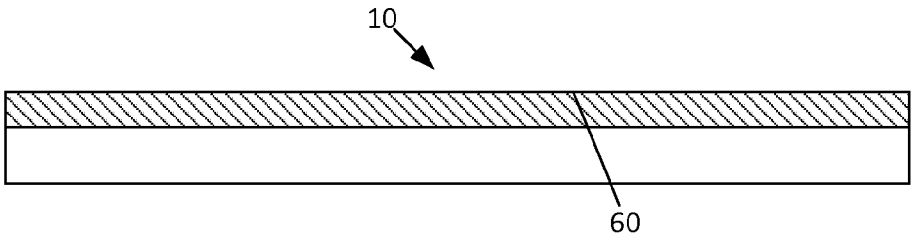
FIG. 20 is a lateral cross-sectional view of a first example cross-sectional shape of the hybrid diving board shown in FIG. 6.
Figure 21:
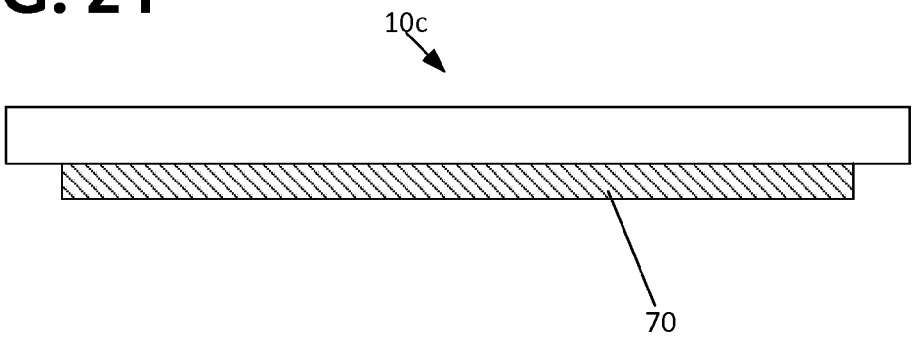
FIG. 21 is a lateral cross-sectional view of a second example cross-sectional shape of the hybrid diving board shown in FIG. 6.

Referring to FIGS. 19-21, additional embodiments of a torsional control spring 60 are shown. As many of the concepts and features of the torsional control spring 60 are similar to the torsional control spring 50, the description for the torsional control spring 50 is hereby incorporated by reference for the torsional control spring 60. As shown, the torsional control spring 60 is mounted to the top surface 16 of the diving board 10 such that a new top surface for the diving board 10 is provided. Accordingly, the spring 60 has a length L7 and width W4 corresponding to the surface area defined by the diving board 10. In one embodiment, the torsional control spring 60 is formed from a composite fiber material in which each layer of material has a fiber orientation of [±60] degrees with respect to a longitudinal axis X of the diving board 10 and torsional control spring 60, such the majority of fiber orientation is directed width wise along the control spring 60. As shown, the torsional control spring 60 has a thickness t5, which may be about 0.2 inches, for example. In one embodiment, the torsional control spring 60 is bonded to the top surface 16 of the diving board 10 with an adhesive.

Referring to FIG. 21, a flex spring 70 is provided on a board 10*c* that has the characteristics of both a secondary flex spring and torsional control spring. As many of the concepts and features of the flex spring 80 are similar to the flex springs 30, 40 and to the torsional control springs 50, 60, the description for the springs 30, 40, 50, 60 is hereby incorporated by reference for the flex spring 70. In this embodiment, the flex spring 70 is provided as a composite structure having the desired stiffness in both the longitudinal and lateral directions. Furthermore, as the spring 70 accounts for a majority of the width of the diving board 10*c*, the flex spring does not have to be secured to the diving board 10*c* in order to provide additional torsional stability.

Materials for the Flex/Torsional Control Spring

The springs 30, 40, 50, 60, and 70 (30-70) may be made from a variety of materials to meet the desired performance characteristics for the hybrid diving board. In one embodiment, the spring 30-70 can include a polymer reinforced composite wherein the polymer matrix is a thermoset resin such as vinyl ester, unsaturated polyester, epoxy, polyurethane, or some other cross-linked polymer system. In one embodiment, the spring 30-70 can be a polymer reinforced composite wherein the fiber reinforcement consists of one or more of the following fiber types: glass, cellulose based natural fiber, carbon, graphite, aramid, ultra high molecular weight polyethylene, or boron fiber.

In one embodiment, the spring 30-70 can be a polymer reinforced composite wherein a central core material is used to separate faces of polymer reinforced fibers, increasing the second area moment of the composite. Core material possibilities include one or more of the following: open or closed cell foams such as polyurethane foam, polyvinyl chloride foam, polyethylene foam, or polystyrene foam; wood; or honeycomb mat structures made of aluminum, paper, or a thermoplastic such as polypropylene.

In one embodiment, the spring 30-70 can include an isotropic material, such as an aluminum alloy, titanium alloy, or steel. In one embodiment, the flex spring 30 includes a metal matrix composite wherein the metal matrix is a lower density metal such as aluminum, magnesium, or titanium. In one embodiment, the spring 30-70 includes a metal matrix composite wherein the fiber reinforcement consists of one or more of the following: nickel or titanium boride coated carbon fiber, boron, alumina, or silicon carbide.

Methods for Producing the Flex/Torsional Control Springs

The spring 30-70 may be produced by a variety of methods. For example, a resin infusion method may be used, such as Vacuum Assisted Resin Transfer Molding (VARTM) or some variation thereof. The flex-spring may include multiple fiber laminate layers comprising single directional fiber plies at angles varying 0-90°, two-dimensional fiber weaves in which fiber orientation varies in the x-y direction, or three-dimensional weaves in which the fiber orientation varies in the x-y-z directions. VARTM parts can be manufactured allowing for pure polymer composite laminate structures as well as sandwich structures, both of varying geometries.

The spring 30-70 may also be formed by a method involving the use of pre-preg laminates, in which either an autoclave or an out-of-autoclave vacuum bagging and oven system is used to form and cure a multiple laminate geometry which has a high fiber volume fraction. Pre-preg laminates can comprise directional fiber plies at angles varying 0-90°. A filament winding method may also be utilized in which a hollow rectangular cross-section is produced with fiber placement such that fibers are oriented in a manner to provide either mainly torsional resistance or a combination of torsional resistance and longitudinal flexural resistance.

Another approach is to utilize a pultrusion method in which either a solid geometry or a geometry with a hollow cross section is pultruded with a predominantly 0° fiber orientation to provide longitudinal flexural resistance. A hollow cross section can be left empty of filled with a foam. Yet another suitable approach is a pulwinding process in which a solid geometry or a geometry with a hollow cross section is produced with both a 0° fiber orientation as well as angled fiber placement to provide torsional stability. A hollow cross section can be left empty of filled with a foam.

The primary subject matter of this disclosure can best be described as a hybrid competition diving board comprised of a dual spring nature, a high performance secondary spring contained within or concurrently located to the main spring, the diving board itself. This dual spring hybrid diving board results in a novel new competition diving board whose performance as defined above exceeds that attainable by the extruded aluminum alloy diving board by itself. It is recognized that the skill and technique of the diver are also critical factors in achieving vertical height from a given diving board. This subject matter of this disclosure may make it possible for a given diver to achieve greater vertical height from the hybrid competition diving board than from current extruded aluminum alloy diving boards of singular composition.

The various embodiments described above are provided by way of illustration only and should not be construed to limit the claims attached hereto. Those skilled in the art will readily recognize various modifications and changes that may be made without following the example embodiments and applications illustrated and described herein, and without departing from the true spirit and scope of the disclosure.

What is claimed is:

1. A hybrid diving board comprising:

a. a primary diving board having a flat top surface and a bottom surface extending between a first end and a second end, the board first end being configured for attachment to a diving stand, the board second end being a free end; and b. a secondary linear flex spring having a first end and a second end, the linear flex spring being adjacent to one of the top and bottom surfaces of the diving board, the linear flex spring first end being configured for attachment to the diving stand or to the diving board at a location proximate the board first end;

c. wherein the hybrid diving board has a spring constant that is higher than a spring constant of the primary diving board.

2. The hybrid diving board of claim 1, wherein the primary diving board has a first longitudinal modulus of elasticity and the flex spring is formed from a material that has a second longitudinal modulus of elasticity that is equal to or greater than the first longitudinal modulus of elasticity.

3. The hybrid board of claim 1, wherein the flex spring has an upward aspheric curve between the flex spring first and second ends such that at least a portion of the flex spring is not in direct contact with the primary diving board bottom surface in an unbiased state.

4. The hybrid board of claim 1, wherein the flex spring extends a length of the primary diving board such that a first distance between the board first and second ends is generally equal to a second distance between the spring first and second ends.

5. The hybrid board of claim 1, wherein the flex spring extends only a partial length of the primary diving board such that a first distance between the board first and second ends is generally greater than a second distance between the spring first and second ends.

6. The hybrid diving board of claim 1, wherein the flex spring includes a plurality of individual flex springs placed in a parallel arrangement.

7. The hybrid diving board of claim 1, wherein the flex spring second end is a free end.

8. The hybrid diving board of claim 1, wherein the flex spring is mechanically attached to the diving board at multiple locations.

9. The hybrid diving board of claim 1, wherein the flex spring has a top surface extending between the flex spring first and second ends, wherein the top surface is adhesively attached to the diving board bottom surface.

10. The hybrid diving board of claim 9, wherein the flex spring is adhesively attached to the diving board along the entire top surface of the flex spring.

11. The hybrid diving board of claim 2, wherein the flex spring is formed from an isotropic material.

12. The hybrid diving board of claim 2, wherein the flex spring is formed from a metal matrix composite material.

13. The hybrid diving board of claim 2, wherein the flex spring is formed from a fiber reinforced polymer composite material.

14. The hybrid diving board of claim 13, wherein the flex spring is formed from carbon fiber.

15. The hybrid diving board of claim 13, wherein the flex spring is formed with a composite structure having multiple laminated layers in which each laminate layer has an architecture consisting of woven or non-woven layers or combinations thereof wherein the layers have a combined average longitudinal modulus of elasticity of at least 70 GPa.

16. The hybrid diving board of claim 15, wherein the combined average longitudinal modulus of elasticity is between 100-400 GPa.

17. The hybrid diving board of claim 1, wherein the primary diving board further includes an aluminum torsion box mounted to the bottom surface of the diving board, the torsion box and the diving board bottom surface defining a first interior volume.

18. The hybrid diving board of claim 17, wherein the flex spring is mounted within the first interior volume.

19. The hybrid diving board of claim 6, wherein the primary diving board further includes a plurality of ribs extending from the bottom surface of the diving boards, the plurality of ribs and the board bottom surface defining a plurality of channels.

20. The hybrid diving board of claim 19, wherein each of the plurality of flex springs is disposed within one of the plurality of channels defined by the ribs and board bottom surface.

21. A hybrid diving board comprising:

a. a primary diving board having a bottom surface extending between a first end and a second end, the board first end being configured for attachment to a diving stand, the board second end being a free end; and b. a secondary linear torsional control spring having a first end and a second end, the secondary linear torsional control spring being adjacent to one of the top and bottom surfaces of the diving board, the secondary linear torsional control spring being secured to the primary diving board such that the secondary linear torsion torsional control spring resists lateral forces applied to the primary diving board;

c. wherein the secondary linear torsional control spring is an anisotropic composite material.

22. The hybrid diving board of claim 21, wherein the secondary linear torsional control spring is formed from a polymer matrix or metal matrix composite fiber structure, such that the orientation of the fiber structure allows resistance to axial or latitudinal rotation of the main spring board due to eccentric loading.

23. The hybrid diving board of claim 21, wherein the secondary linear torsional control spring is one of a flat rectangular laminate, a flat rectangular sandwich structure, and a hollow rectangular box structure.

24. The hybrid diving board of claim 21, wherein the secondary linear torsional control spring is attached mechanically or by adhesive means along a bottom side of the diving board.

25. The hybrid diving board of claim 21, wherein the secondary linear torsional control spring is attached mechanically or by adhesive means along a top side of the diving board.

26. The hybrid diving board of claim 21, wherein the secondary linear torsional control spring is slidable in a longitudinal direction relative to the primary diving board.

27. The hybrid diving board of claim 21, wherein the secondary linear torsional control spring is secured to the primary diving board by at least one bracket.

28. The hybrid diving board of claim 27, wherein the secondary linear torsional control spring is secured to the primary diving board by a first bracket near the first end of the primary diving board and a second bracket near the second end of the primary diving board.

29. The hybrid diving board of claim 28, wherein the secondary linear torsional control spring is slidable relative to the first and second brackets in a lengthwise direction of the secondary linear torsional control spring.

30. The hybrid diving board of claim 21, wherein the secondary linear torsional control spring also functions as a secondary flex spring such that the hybrid diving board has a spring constant in a longitudinal direction that is higher than a spring constant of the primary diving board.

31. The hybrid diving board of claim 1, wherein the secondary linear flex spring and the primary diving board have deflection profiles that curve about a fulcrum of the diving stand.

32. The hybrid diving board of claim 21, wherein the torsional control spring, including the first end and the second end, extends at least partially along and adjacent to one of the top and bottom surfaces of the diving board.

33. A hybrid diving board comprising:

a. a primary diving board having a flat top surface and a bottom surface extending in a direction between a first end and a second end, the board first end being configured for attachment to a diving stand, the board second end being a free end; and b. a secondary flex spring having a first end and a second end and being configured for attachment to one of the diving stand and the diving board, the flex spring having a surface extending between the first and second ends, the surface extending:

i. adjacent to at least part of one of the top and bottom surfaces of the diving board; and ii. in the same direction as the primary diving board;

c. wherein the hybrid diving board has a spring constant that is higher than a spring constant of the primary diving board.

* * * * *